US006908016B2

(12) United States Patent
Chen

(10) Patent No.: US 6,908,016 B2
(45) Date of Patent: Jun. 21, 2005

(54) MODIFIED FRAME STYLE CAULKING GUN

(75) Inventor: Lianrui Chen, Tianjin (CN)

(73) Assignee: Tianjin Jinmao Corp., Ltd., Tianjin (CN)

( * ) Notice: Subject to any disclaimer, the term of this patent is extended or adjusted under 35 U.S.C. 154(b) by 66 days.

(21) Appl. No.: 10/675,757

(22) Filed: Sep. 30, 2003

(65) Prior Publication Data

US 2004/0206784 A1 Oct. 21, 2004

(30) Foreign Application Priority Data

Apr. 16, 2003 (CN) ..... 03245228 U

(51) Int. Cl.[7] ..... A67D 5/42
(52) U.S. Cl. ..... 222/391
(58) Field of Search ..... 222/327, 391

(56) References Cited

U.S. PATENT DOCUMENTS 6,386,401 B1 * 5/2002 Dodd et al. ..... 222/391

OTHER PUBLICATIONS http://www.jinamo.com/index.htm; pp. 1–2 2001.

http:www.jinmao.com/jinmaocaulk.htm; pp. 1–15 2001.

http://www.jinmao.com/caulk/large/JM–3001S.ipg 2001.

* cited by examiner

*Primary Examiner*—Philippe Derakshani
(74) *Attorney, Agent, or Firm*—Baker & Hostetler LLP

(57) ABSTRACT

A modified frame style caulking gun includes a gun body with front and back blocks to receive a caulk cartridge, a gun rack in close fitting with the gun body and having a trigger, a frame driving section having structure for distally moving a push rod upon proximal movement of the trigger for releasing caulk via a spout of the caulk cartridge, and a braking assembly for preventing movement of the push rod. The gun rack and gun body include structure for providing a strong and rigid connection there between. The caulking gun includes structure for performing the functions of cutting the nib or distal end of the spout of the caulk cartridge and dredging the mouth of the caulk cartridge.

19 Claims, 2 Drawing Sheets

MODIFIED FRAME STYLE CAULKING GUN

PRIORITY

This application claims priority under 35 U.S.C. Section 119 from a Chinese patent application filed on Apr. 16, 2003 and assigned Chinese Patent Application Filing Number 03245228.4, the contents of this Chinese patent application are incorporated herein by reference in their entirety.

TECHNICAL FIELD

The present invention relates to a caulking gun, and more particularly to a modified frame style caulking gun.

BACKGROUND OF THE INVENTION

In a conventional caulking gun, a front block and a back block are mounted on a gun body. A caulk-cleaning needle is pin jointed at the lower end of the front block, and a needle-securing groove is formed at the protruding ridge of the gun body; a rabbet-type through hole is formed on the central portion of the back block. A fixed handle is provided on the outside of the back block, and a through hole is formed on the fixed handle. A forward push element is fixed at the front end of a push rod. A driving element and a driving spring are mounted surrounding the push rod and are placed inside the gun body. A trigger is pin jointed to the fixed handle through a pivot on which a dialing spring is set. A driving shaft is provided on the trigger, and the driving element is extended to the front of the driving shaft in the trigger. An adjusting part encircles the push rod. The forward push element on the push rod pushes ahead the pistol of the caulk cartridge to push out caulk It is an aspect of the present invention to provide a caulking gun having a modified frame and novel structure, and thereby providing several advantages over conventional caulking guns.

SUMMARY OF THE INVENTION

The present invention provides a caulking gun having a modified frame and novel structure. The modified frame style caulking gun according to the present invention includes a gun body in fixed alignment with a gun rack having a trigger, and a push rod capable of traversing through the gun rack and the gun body. The gun rack is located proximally with respect to the gun body which is configured and dimensioned for receiving a caulk cartridge. As used herein, the word "distal" refers to that portion of the caulking gun, or component thereof which is further from the user while the word "proximal" refers to that portion of the caulking gun or component thereof which is closer to the user.

The gun rack includes a frame driving section, a jointing section and a fixed handle. The jointing section is provided at a distal end of the gun rack. The jointing section includes a central through hole for receiving at least one coupling component for strongly and rigidly connecting the gun rack and the gun body.

The frame driving section which includes a driving girder, a driving chamber, a T-shaped braking bolt and a braking bulge is located proximally with respect to the jointing section. The driving chamber is a quadrate chamber formed with two parallel jambs for providing strength to the connection between the gun rack and the gun body and is located proximally with respect to the jointing section. The fixed handle is located under the driving chamber. The driving girder is provided between the fixed handle and the jointing section. A pin hole for pin jointing the trigger to the driving girder is provided on the driving girder. The braking bolt and the braking bulge protrude proximally from a back wall of the driving chamber. A through hole for allowing the push rod to pass through the gun rack and gun body is provided in the back wall of the driving chamber, or between the T-shaped braking bolt and the braking bulge.

In order for the gun body to receive the caulk cartridge, a front block is welded at a distal end thereof. The front block includes an opening for mounting and supporting a nozzle or spout of the caulk cartridge. A cylindrically-shaped back block is welded to the gun body at a proximal location with respect to the front block. An assembling hole for coupling with the at least one coupling component, such as a screw having a central through hole, is provided at a central portion of the back block for coupling the back block with the gun rack at the jointing section.

After coupling the back block with the gun rack, the central through hole of the at least one coupling component aligns with the central through hole of the driving chamber and the push rod for traversal of the push rod through the gun rack and gun body via the two central through holes. A forward push element shaped as a flat disc is fixed via a nut or other connecting device at a distal end of the push rod. The flat disc is configured to push out caulk from the caulk cartridge as the trigger is moved proximally, i.e., towards the fixed handle.

A position-limiting tube, a driving element and a driving spring are mounted within the driving chamber of the gun rack and surround the push rod. The driving element is provided distally with respect to a driving shaft on the trigger in order for the driving shaft to push the driving element distally upon proximal movement of the trigger to create a driving force for also moving the push rod distally.

A braking assembly includes a braking element which can be caught by the T-shaped braking bolt and a braking spring surrounding the push rod on the outside of the driving chamber adjacent to the back wall. The braking bulge acts as a fulcrum for the braking element. The braking assembly prevents movement of the push rod.

The modified frame style caulking gun of the present invention includes a streamlined bulge protruding on the outside of the fixed handle, and a protruding rib is formed on the inside of the fixed handle. A first pin jointing hole for pin jointing a caulk-cleaning needle is provided on the upper portion of the protruding rib in proximity to the bulge. A protruding step is provided for catching the caulk-cleaning needle on the lower portion of the protruding rib. The caulk-cleaning needle is used for dredging the spout of the caulk cartridge.

An ergonomically designed curving portion for ease of handling the caulking gun by a user is formed on a lower to middle part of the trigger. The upper part of the trigger is formed as two parallel driving arms which is pin jointed on the driving girder of the gun rack through a pivot which is encircled by a dialing spring.

The driving shaft is riveted between the two driving arms on the top end of the trigger. A cutting assembly for cutting a nib or a distal end of the spout of the caulk cartridge includes a cutting member which is provided to the top part of the trigger and held in place by the driving shaft and the pivot encircled by the dialing spring. The cutting member extends opposite the curved portion of the trigger and is movable along a circular path upon movement of the trigger. A blade is formed or provided on an edge of the cutting member for cutting the nib or the distal end of the spout of the caulk cartridge while inserted within a caulk-cutting hole. The blade is maintained within the driving chamber at all times to prevent the user from accidentally injuring himself and the caulk-cutting hole is preferably dimensioned to prevent a user's finger from entering the driving chamber.

A female rabbet is provided at the end section of the jointing section and is concentric with the central through hole of the jointing section for receiving a male tab plastic gasket. A plastic gasket is provided between the back block of the gun body and the at least one coupling component, and the male tab plastic gasket is provided between the back block and the gun rack to match with the female rabbet at the end section of the jointing section for coupling and securing the gun rack and the gun body. This structure fastens the binding of the gun body and gun rack.

The modified frame style caulking gun according to the present invention is easy to assemble and improves the strength of the caulking gun. Further, the modified frame style caulking gun includes structure for performing the functions of cutting the nib of the caulking cartridge and dredging the spout of the caulk cartridge. Therefore, the caulking gun of the present invention provides for the performance of additional functions. Additionally, the modified frame style caulking gun is convenient, safe and reliable.

DETAILED DESCRIPTION OF THE PREFERRED EMBODIMENTS

Reference will now be made in detail to the preferred embodiments of the present invention, examples of which are illustrated in the accompanying drawings. A preferred embodiment of the modified frame style caulking gun corresponds to the JM-3001S caulking gun manufactured and commercially available from Tianjin Jinmao Corporation, Ltd., having offices and manufacturing facilities in Tianjin, China. Documents showing the structural configuration, and detailing the specifications and method of operation of the JM-3001S caulking gun are incorporated herein by reference.

Figure 1:
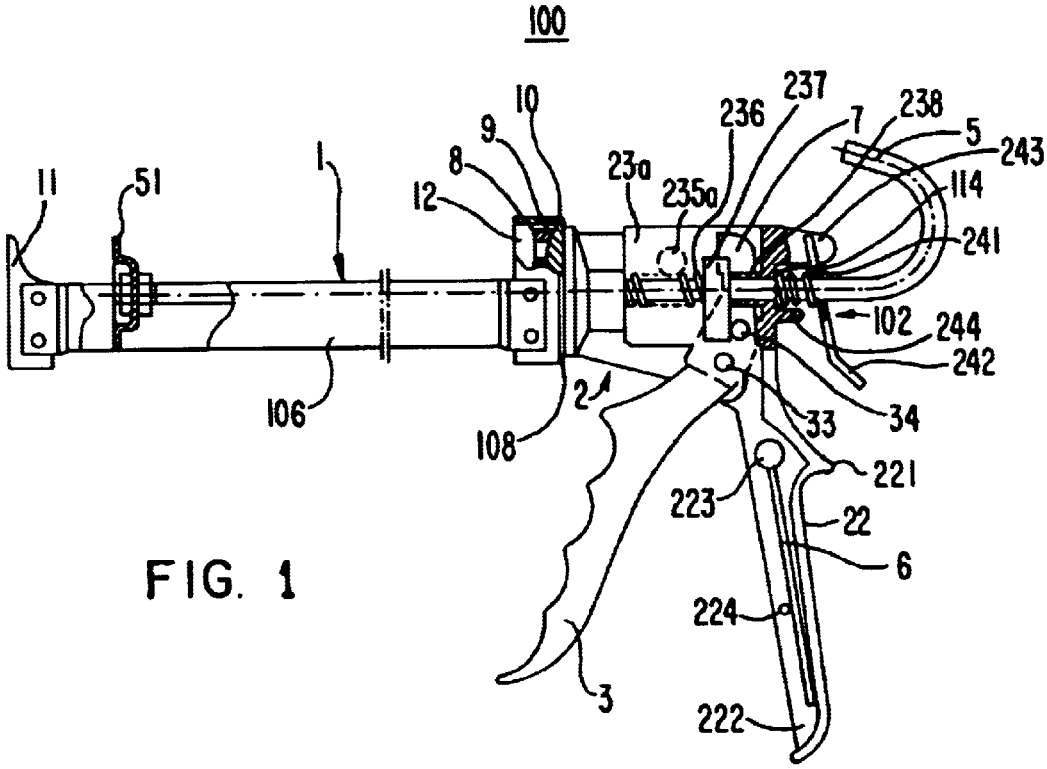
FIG. 1 is a side partially phantom view of the modified frame style caulking gun in accordance with the present invention.

Referring to FIG. 1, a preferred embodiment of the modified frame style caulking gun is shown and designated generally by reference numeral 100. The caulking gun 100 includes a gun body 1 in fixed aligned with a gun rack 2 having a trigger 3, and a push rod 5 capable of traversing the gun rack 2 and the gun body 1. The gun rack 2 is located proximally with respect to the gun body 1 which is configured and dimensioned for receiving a caulk cartridge. As used herein, the word "distal" refers to that portion of the caulking gun 100, or component thereof which is further from the user while the word "proximal" refers to that portion of the caulking gun 100 or component thereof which is closer to the user.

Figure 2B:
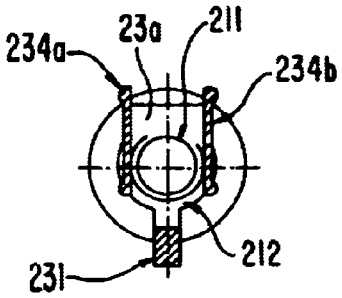
FIG. 2*b* is a front view of a driving girder and other components of the gun rack shown by FIG. 2*a*.
Figure 2A:
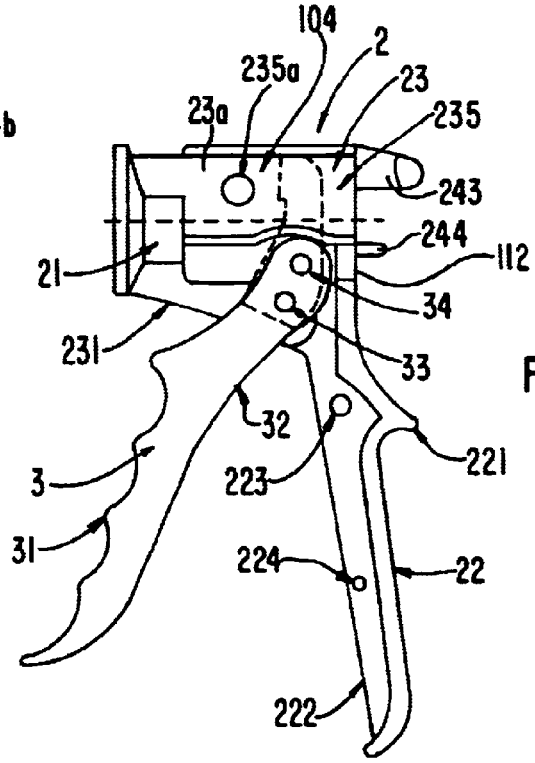
FIG. 2*a* is an enlarged, side phantom view of a gun rack of the caulking gun shown by FIG. 1.

The gun rack 2 is preferably integrally formed by cast-molding. As shown by FIGS. 2*a* and 2*b*, the gun rack 2 includes a frame driving section 23 having a jamb 235, a jointing section 21 and a fixed or stationary handle 22. The jointing section 21 is provided at a distal end of the gun rack 2. A female central hole 211 is formed on the jointing section 21 for receiving at least one coupling component for connecting the gun rack 2 and the gun body 1. The at least one coupling component may include a screw 8, rabbet or other well-known coupling components, and has a central through hole for allowing the push rod 5 to traverse through the gun rack 2 and gun body 1.

A female rabbet 212 is preferably provided at the end section of the jointing section 21 and is concentric with the central hole 211 of the jointing section 21 for receiving a male tab plastic gasket 10. A plastic gasket 9 is provided between a cylindrically-shaped back block 12 of the gun body 1 and the at least one coupling component, and the male tab plastic gasket 10 is provided between the back block 12 and the gun rack 2 to match with the female rabbet 212 at the end section of the jointing section 21 for coupling and securing the gun rack 2 and the gun body 1. This structure fastens the binding of the gun body 1 and gun rack 2.

The driving section 23 which includes a driving girder 231, a driving chamber 23*a*, a braking bolt 243 and a braking bulge 244 is provided proximally with respect to the jointing section 21. The braking bolt 243 and the braking bulge 244 are part of a braking assembly 102 as further described below.

The driving chamber 23*a*, as shown by FIG. 2*b*, is a quadrate chamber formed with two parallel jambs 234*a*, 234*b* for providing strength to the connection between the gun rack 2 and the gun body 1 and is located proximally with respect to the jointing section 21. The jambs 234*a*, 234*b* act as reinforcing bars for maintaining a strong and rigid connection between the gun rack 2 and the gun body 1. Hence, the jambs 234*a*, 234*b* provide strength and rigidity to the caulking gun 100, especially at the gun rack-gun body connection point.

The fixed handle 22 is located under the driving chamber 23*a*. A streamlined bulge 221 protrudes proximally from the fixed handle 22 and is ergonomically designed for a user's thumb to rest thereon for securely grasping the caulking gun 100. A protruding rib 222 is formed on the inside of the fixed handle 22. A first pin jointing hole 223 for pin jointing a caulk-cleaning needle 6 is provided on the upper portion of the protruding rib 222 in proximity to the bulge 221. A protruding step 224 is provided for catching the caulk-cleaning needle on the lower portion of the protruding rib 222. Hence, the caulk-cleaning needle 6 is secured to the fixed handle 22 and is prevented from unintentionally moving during use of the caulking gun 100. The caulk-cleaning needle 6 is used for dredging the spout of the caulk cartridge.

The driving girder 231 is provided between the fixed handle 22 and the jointing section 21. A pin hole for pin jointing the trigger 3 to the driving girder 231 is provided on the driving girder 231. The braking bolt 243 and the braking bulge 244 which are part of the braking assembly 102 protrude proximally from a back wall 112 of the driving chamber 23*a*. The braking bolt 243 is preferably T-shaped for catching and securing the braking element 242. The braking bulge 244 acts as a fulcrum under the braking bolt 243 as shown by FIGS. 1 and 2*a*. A through hole 114 for allowing the push rod 5 to pass through the gun rack 2 and the gun body 1 is provided in the back wall 112 of the driving chamber 23*a*, or between the braking bolt 243 and the braking bulge 244.

An ergonomically designed curving or knurled portion 31 for ease of handling the caulking gun 100 by a user is formed on a lower to middle part of the trigger 3. The upper part of the trigger 3 is formed as two parallel driving arms 32 which is pin jointed on the driving girder 231 of the gun rack 2 through a pivot 33 which is encircled by a dialing spring. A driving shaft 34 is riveted between the two driving arms 32 on the top end of the trigger 3.

A cutting assembly 104 for cutting a nib or a distal end of the spout of the caulk cartridge includes a cutting member 110 which is provided to the top part of the trigger 3 and held in place by the driving shaft 34 and the pivot 33 encircled by the dialing spring. The cutting member 110 extends opposite the curved portion 31 of the trigger 3 and is movable along a circular path upon movement of the trigger 3. A blade 7 is formed or provided on an edge of the cutting member 110 for cutting the nib or the distal end of the spout of the caulk cartridge while inserted within a caulk-cutting hole 235*a* provided on the jamb 235 prior to positioning the caulk cartridge within the gun body 1. The blade 7 is maintained within the driving chamber 23*a* at all times to prevent the user from accidentally injuring himself and the caulk-cutting hole is preferably dimensioned to prevent a user's finger from entering the driving chamber 23*a*.

The push rod 5 is J-shaped as shown by FIG. 1. A proximal end of the push rod is curved for conveniently being grasped by a user for pulling the push rod 5 proximally after a caulk cartridge has been spent to remove the spent caulk cartridge. A major part of the non-curved section of the push rod 5 is designed for traversing the gun rack 2 and gun body 1 via through holes in the gun rack 2 and the gun body 1 and for compressing the caulk within the caulk cartridge to release caulk from the spout.

To accomplish the latter task, a forward push element 51 shaped as a flat disc is fixed via a nut or other connecting device at a distal end of the push rod 5. The flat disc is configured to push out caulk from the caulk cartridge as the trigger 3 is moved proximally, i.e., towards the fixed handle 22, as known in the art.

A position-limiting tube 238, a driving element 237 and a driving spring 236 are mounted within the gun rack 2 and surround the push rod 5 within the driving chamber 23*a* of the gun rack 2. The driving element 237 is provided distally with respect to the driving shaft 34 on the trigger 3, in order for the driving shaft 34 to push the driving element 237 distally upon proximal movement of the trigger 3 to create a driving force for also moving the push rod distally.

The braking assembly 102, besides the braking bolt 243 and braking bulge 244, further includes a braking element 242 which can be caught by the T-shaped braking bolt 243 and a braking spring 241 surrounding the push rod on the outside of the driving chamber 23*a* adjacent to the back wall 112. The braking bulge 244 acts as a fulcrum for the braking element 242. The braking assembly 102 prevents movement of the push rod 5.

The gun body 1 includes a semi-cylindrical support 106 configured and dimensioned for receiving a caulk cartridge. A front block 11 having a U-shaped opening is provided to the semi-cylindrical support 106 for mounting and supporting the caulk nozzle or spout. The front block 11 is welded at a distal end of the support 106. The cylindrically-shaped back block 12 is welded to the gun body 1 at a proximal location with respect to the front block 11. An assembling hole 108 for coupling with the at least one coupling component, such as a screw 8 having a central through hole, is provided at a central portion of the back block 12 for coupling the back block 12 with the gun rack 2.

After coupling the back block 12 with the gun rack 2, a central through hole of the at least one coupling component aligns with the central through hole 211 of the driving chamber 23*a* and the push rod 5 for traversal of the push rod 5 through the gun rack 2 and gun body 1 via the two central through holes.

The method of operation of the modified frame style caulking gun 100 according to the present invention is similar as with conventional caulking guns, and hence, a detailed description of the method of operation is not presented herein.

The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. Thus, it is intended that the present invention cover the modifications and variations of this invention provided they come within the scope of the appended claims and their equivalents.

What is claimed is:

1. A caulking gun comprising a gun rack, a gun body connected to the gun rack, and a push rod configured to traverse through the gun rack and the gun body;

wherein said gun rack includes a trigger, a driving section, a jointing section and a fixed handle; said jointing section is provided at a distal end of the gun rack and defines a hole for receiving at least one coupling component; said driving section includes a driving girder, a driving chamber, a braking bolt and a braking bulge and is located proximally with respect to said jointing section; said fixed handle is located under the driving chamber, said driving girder is provided between the fixed handle and the jointing section and a pin hole for pin jointing the trigger to the driving girder is defined thereon; said braking bolt and said braking bulge protrude proximally from a back wall of the driving chamber and a push rod through hole for allowing the push rod to pass through is defined on the back wall between the braking bolt and the braking bulge;

said trigger is pin jointed on the driving girder of the gun rack via the pin hole;

said caulking gun further comprising:

a front block at a distal end of the gun body for supporting a caulk cartridge nozzle, a back block at a proximal end of the gun body and defining an assembling hole for coupling with at least one coupling component, said gun body is fixed to the gun rack by the at least one coupling component which defines a through hole for traversal of said push rod there through;

a forward push element is fixed at the front end of the said push rod; a position-limiting tube, a driving element and a driving spring are provided within the driving chamber and surround the push rod; said driving element is moved distally by a driving shaft as the trigger is moved proximally, said driving element compressing the driving spring as it moves distally; a braking assembly including braking element caught by the braking bolt prevents movement of the push rod, said braking bulge acts as a fulcrum for the braking element.

2. The caulking gun as in claim 1, further comprising a bulge protruding proximally from said fixed handle from a mid to upper portion thereof, a protruding rib formed on a surface of the said fixed handle, and means for securing a caulk-cleaning needle to the protruding rib.

3. The caulking gun as in claim 1, wherein the trigger includes a portion configured and dimensioned for grasping by a user's hand, and an upper part of the trigger is formed as two parallel driving arms which is movably connected to the driving girder of the gun rack.

4. The caulking gun as in claim 3, wherein the driving shaft is connected to the two driving arms on a top end of the trigger, said caulking gun further comprising a cutting member connected to the top end of the trigger and having a blade capable of moving along a path upon movement of the trigger for cutting an object positioned within a cutting hole of the gun rack.

5. The caulking gun as in claim 1, wherein a female rabbet is provided at the distal end of the said jointing section and is concentric with said hole for receiving a male tab gasket.

6. The caulking gun as in claim 5, wherein a gasket is provided between said back block of the gun body and the at least one coupling component, and wherein said male tab gasket is provided between the back block and the gun rack and matches with the female rabbet at the distal end of the jointing section.

7. The caulking gun as in claim 1, wherein said driving chamber is a quadrate chamber formed with two parallel jambs on either side of said hole.

8. In a caulking gun of the type having a gun rack, a gun body, and a push rod configured to traverse through the gun rack and the gun body, the gun rack having a fixed handle and a trigger for causing distal movement of the push rod as it moves towards the fixed handle, the improvement comprising:

a female rabbet at a distal end of the gun rack and being concentric with a hole defined by the gun rack for passage of said push rod through said female rabbet and gun rack, said female rabbet configured for receiving a male tab gasket provided between the gun body and the gun rack for connecting the gun body and the gun rack, said male tab gasket matches the female rabbet for securing said female rabbet and male tab gasket.

9. In the caulking gun as in claim 8, the improvement further comprising a quadrate driving chamber formed with two parallel jambs on either side of said hole.

10. In the caulking gun as in claim 8, the improvement further comprising a bulge protruding proximally from said fixed handle from a mid to upper portion thereof, a protruding rib formed on a surface of the said fixed handle, and means for securing a caulk-cleaning needle to the protruding rib.

11. In the caulking gun as in claim 8, the improvement further comprising the trigger being ergonomically designed by having a curving portion configured and dimensioned for grasping by a user's hand.

12. In the caulking gun as in claim 8, the improvement further comprising a cutting member connected to the top end of the trigger and having a blade capable of moving along a path upon movement of the trigger for cutting an object positioned within a cutting hole of the gun rack.

13. In the caulking gun as in claim 8, the improvement further comprising a caulk cleaning needle and means for securing said caulk-cleaning needle to said gun rack.

14. In a caulking gun of the type having a gun rack, a gun body, and a push rod configured to traverse through the gun rack and the gun body, the gun rack having a fixed handle and a trigger for causing distal movement of the push rod as it moves towards the fixed handle, the improvement comprising:

a quadrate driving chamber at a distal end of the gun rack and formed with two parallel jambs on either side of a hole dimensioned for passage of said push rod there through.

15. In the caulking gun as in claim 14, the improvement further comprising a female rabbet at a distal end of the gun rack and being concentric with the for passage of said push rod through, said female rabbet configured for receiving a male tab gasket provided between the gun body and the gun rack which matches the female rabbet for securing said female rabbet and male tab gasket for connecting the gun body and the gun rack.

16. In the caulking gun as in claim 14, the improvement further comprising a bulge protruding proximally from said fixed handle from a mid to upper portion thereof, a protruding rib formed on a surface of the said fixed handle, and means for securing a caulk-cleaning needle to the protruding rib.

17. In the caulking gun as in claim 14, the improvement further comprising the trigger being ergonomically designed by having a curving portion configured and dimensioned for grasping by a user's hand.

18. In the caulking gun as in claim 14, the improvement further comprising a cutting member connected to the top end of the trigger and having a blade capable of moving along a path upon movement of the trigger for cutting an object positioned within a cutting hole of the gun rack.

19. In the caulking gun as in claim 14, the improvement further comprising a caulk cleaning needle and means for securing said caulk-cleaning needle to said gun rack.

* * * * *